US005857339A

United States Patent [19]

Roquemore et al.

[11] Patent Number: 5,857,339

[45] Date of Patent: Jan. 12, 1999

[54] COMBUSTOR FLAME STABILIZING STRUCTURE

[75] Inventors: William M. Roquemore, Dayton; Dale T. Shouse; Kuang-Yu M. Hsu, both of Beavercreek, all of Ohio

[73] Assignee: The United States of America as represented by the Secretary of the Air Force, Washington, D.C.

[21] Appl. No.: 447,518

[22] Filed: May 23, 1995

[51] Int. Cl.[6] ..... F02C 1/00

[52] U.S. Cl. ..... 60/749; 60/743; 413/116

[58] Field of Search ..... 60/738, 743, 749; 431/9, 115, 116

[56] References Cited

U.S. PATENT DOCUMENTS

| | | | |
|---|---|---|---|
| 3,007,310 | 11/1961 | Eisele | 431/115 |
| 3,880,571 | 4/1975 | Koppang et al. | 431/116 |
| 4,455,839 | 6/1984 | Wuchter | 60/749 |
| 4,676,736 | 6/1987 | Alpqvist | 431/243 |
| 5,014,631 | 5/1991 | Ikeda et al. | 110/264 |
| 5,123,361 | 6/1992 | Nieh et al. | 110/264 |
| 5,540,583 | 7/1996 | Keller et al. | 431/116 |

*Primary Examiner*—Charles G. Freay

*Attorney, Agent, or Firm*—Bobby D. Scearce; Thomas L. Kundert

[57] ABSTRACT

A combustor structure is described which comprises a cavity defined in the combustor for trapping a vortex of fuel, air and hot combustion products to stabilize the flame, the cavity being formed in any suitable way such as being defined between two or more bluff bodies in tandem, or in a wall of the combustor, or in the combustor liner, and wherein fuel and air are injected directly into the fuel/air recirculation zone defined by the trapped vortex.

1 Claim, 4 Drawing Sheets

COMBUSTOR FLAME STABILIZING STRUCTURE

RIGHTS OF THE GOVERNMENT

The invention described herein may be manufactured and used by or for the Government of the United States for all governmental purposes without the payment of any royalty.

BACKGROUND OF THE INVENTION

The present invention relates generally to combustor structures, and more particularly to an improved structure for flame stabilization within a combustor.

Existing combustor and commercial burners generally use recirculating flows to stabilize the flame. Recirculation zones provide regions of low velocity fluid where burning can occur, and provide mixing of fuel, air and hot products and a continuous ignition source that sustains the flame by transporting the hot mixture back towards the face of the combustor. Swirl, bluff bodies and rearward facing steps, or combination of these, are commonly used to create recirculation zones. Swirl is used in most practical combustors and burners. However, swirling flames have undesirably narrow stable operating ranges, and in some applications are long, all a result of aerodynamic instabilities of the recirculation zone and poor fuel and air mixing. Bluff bodies and rearward facing steps are also used to create recirculation zones that promote flame holding in much the same way as swirl stabilized flames. However, recirculation zones behind bluff bodies and rearward facing steps are less stable and have longer flame lengths than those established using swirl. Also, recirculation zones established by bluff bodies or rearward facing steps do not entrain a large quantity of free stream fluid and have a minimal impact on mixing. As a result of these problems, use of bluff bodies and rearward facing steps for flame stabilization is limited to high speed premixed combustion systems such as ramjets and gas turbine engine afterburners.

The invention solves or substantially reduces in critical importance problems with prior state-of-the-art combustor structures by providing a flame stabilizing structure comprising two or more bluff bodies in tandem or otherwise defining a cavity within which a trapped vortex defines a stable recirculation zone, with fuel and air injection directly into the recirculation zone, to sustain the flame. The invention provides flame stabilization within wide ranges of fuel and air flow conditions not achievable within previously existing structures. The invention further provides a simple and compact structure within which the fuel to air ratio may be controlled in the trapped vortex independently of the incoming air and fuel flow rates, which feature provides active combustion control and stable combustion with high efficiency and low exhaust pollutants over a wider range of operating conditions than are achievable in conventional combustor structures.

It is therefore a principal object of the invention to provide a simple, compact and low cost flame stabilizing structure for a combustor that allows stable operation over a wide range of fuel and air flow conditions with low lean blow-out limits, good relight capabilities and low specific fuel consumption.

It is a further object of the invention to provide an efficient, low pressure drop, low polluting flame stabilization structure for a combustor.

It is yet another object of the invention to provide an improved flame stabilizing combustion source structure for gas turbine combustors, afterburners, ramjet combustors, flight line heaters, commercial boilers, furnaces, waste incinerators, and the like.

These and other objects of the invention will become apparent as a detailed description of representative embodiments proceeds.

SUMMARY OF THE INVENTION

In accordance with the foregoing principles and objects of the invention, a combustor structure is described which comprises a cavity defined in the combustor for trapping a vortex of fuel, air and hot combustion products to stabilize the flame, the cavity being formed in any suitable way such as being defined between two or more bluff bodies in tandem, or in a wall of the combustor, or in the combustor liner, and wherein fuel and air are injected directly into the fuel/air recirculation zone defined by the trapped vortex.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
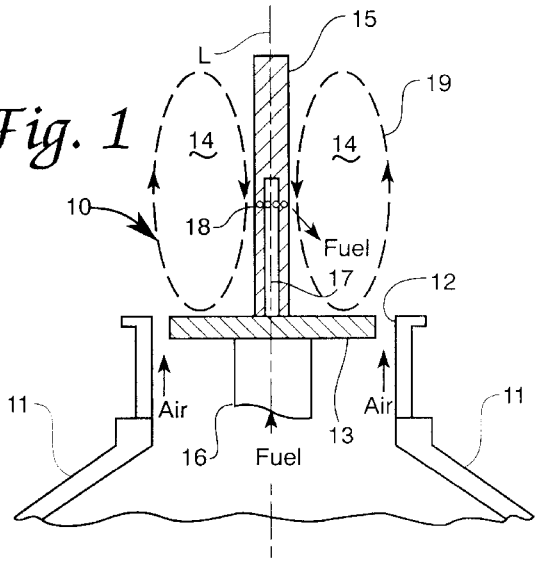
FIGS. 1 and 2 illustrate in axial section structures providing short term limited flame stabilization in a combustor.
Figure 2:
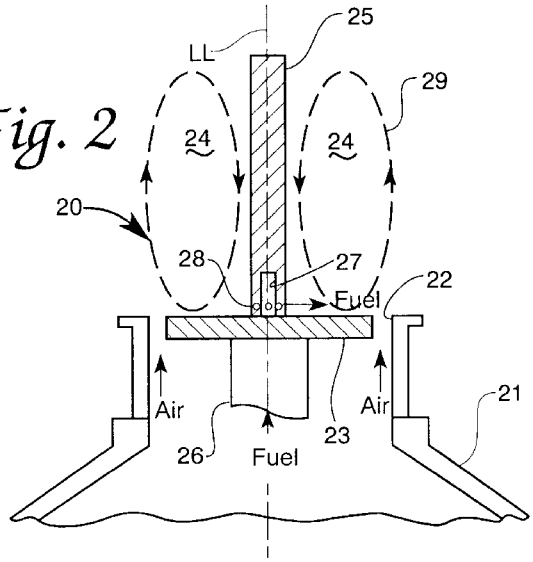

Referring now to the drawings, FIGS. 1 and 2 show in axial section two primitive fuel nozzle and flame holding structures 10,20 providing limited flame holding capability and short term flame stabilization in a combustor, each structure including an axisymmetric body extending from and supported on a disk and supporting a flame in the region surrounding the axisymmetric body. In structures 10,20, air is supplied from the engine compressor or other source (not shown) through respective ducts 11,21 and air inlets 12,22 defined annularly around or through disk members 13,23 into respective flame holding regions 14,24 surrounding axisymmetric bodies 15,25. Fuel is supplied through fuel lines 16,26 through disks 13,23 in each structure and into respective axial bores 17,27 for injection into respective flame holding (burn) regions 14,24. In structure 10 of FIG. 1, bore 17 extends a preselected distance axially of body 15 and terminates near a plurality of spaced circumferential fuel jets 18 defined through the wall of body 15, typically at an angle to the centerline L of body 15 for injecting fuel into region 14 at preselected angle (typically 45°) for mixing and burning with air supplied from air inlets 12. A vortex 19 defined by a recirculation zone within region 14 may be established and temporarily and spatially stabilized by bodies 15 and 13 and suitable combinations of parameters defining fuel and air flow from air inlets 12 and fuel jets 18. Similarly, in the configuration shown in FIG. 2, fuel jets 28 are defined through the wall of body 25 for injecting fuel into region 24 (typically at 90° to centerline LL) and along the surface of disk 23 substantially as shown for mixing and burning with air supplied from air inlets 22. A vortex 29 defined in region 24 may be established and temporarily and spatially stabilized by suitable fuel and air flow parameters as in structure 10. The combustion in either of the structures 10,20 results in long flame lengths because the central fuel jet penetrates the recirculation zone established within regions 14,24 and burns downstream, and the flame cannot be stabilized indefinitely under a wide range of fuel and air flow parameters.

In accordance with a principal feature of the invention, a vortex may be trapped in a cavity to stabilize a flame with direct fuel and air injection into the vortex to enhance and provide control of the combustion process within a combustor. The cavity structure within which the vortex may be trapped for the purpose of flame stabilization may, within the scope of the teachings hereof and of the appended claims, be of substantially any configuration as would occur to one with skill in the combustor art in applying the teachings of the invention to a specific combustor or burner type, such as that defined between two or more bluff bodies in tandem or between two or more rearward facing steps in tandem, or as a suitably formed cavity in the combustor liner or in an inner wall of the combustor. Various examples of structures defining a cavity within which a flame may be stabilized according to the invention are suggested in FIGS. 3–8. It is noted, however, that the specific structures shown and described herein are exemplary only of the many structures and variations thereof which are contemplated herein, as would occur to the skilled artisan guided by these teachings, and which are within the scope of the appended claims. Performance characteristics and experimental data on a trapped vortex combustor according to the invention are also presented in Hsu et al, "Characteristics of a Trapped-Vortex (TV) Combustor," Proceedings of the Technical Meeting, Central States Section of The Combustion Institute, *Combustion Fundamentals & Applications*, pp 424–429 (1994), and in Hsu et al, "Performance of a Trapped-Vortex Combustor," AIAA 95-0810, 33rd AIAA Aerospace Sciences Meeting and Exhibit (1995), the entire teachings of which are incorporated by reference herein.

Figure 3:
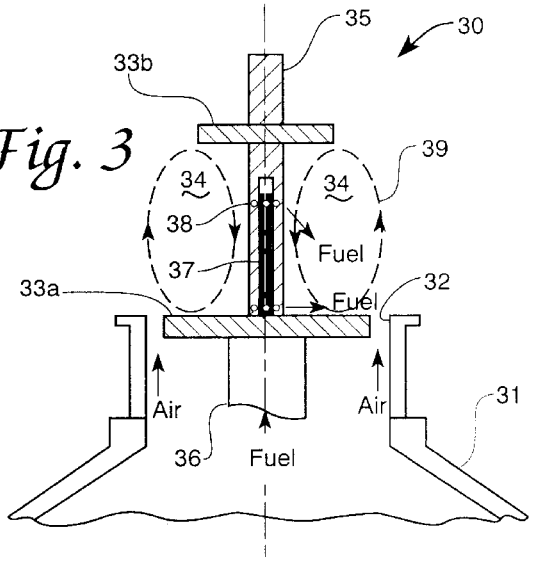
FIGS. 3 and 4 illustrate in axial section two representative combustor structures according to the invention comprising a pair of bluff bodies in tandem for flame stabilization utilizing a trapped vortex.
Figure 4:
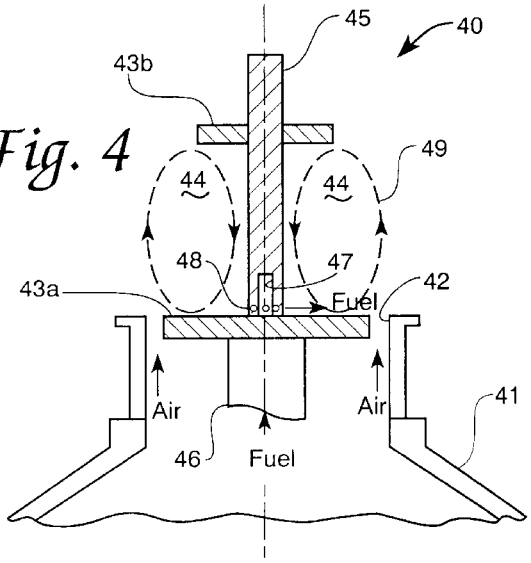

Referring now to FIGS. 3 and 4, illustrated therein in axial section are two representative combustor structures according to the invention, and built and operated in demonstration thereof, which comprise a pair of bluff bodies disposed in tandem for supporting and stabilizing a flame therebetween. The structures of FIGS. 3 and 4 have some correspondence with those illustrated respectively in FIGS. 1 and 2 and were constructed and operated and are compared herein to demonstrate the substantially improved structure taught by the invention wherein a vortex is trapped between the bluff bodies for stabilizing the flame. Accordingly, certain structural components of the structures of FIGS. 3 and 4 have substantially the same function as similarly named components in the structures of FIGS. 1 and 2. In FIGS. 3 and 4, fuel nozzle and flame holding structures 30,40 each include an axisymmetric body supported between two disk-shaped bluff bodies between which a flame is supported in the operation of the combustor. Ducts 31,41, air inlets 32,42 and fuel lines 36,46 serve the same functions as similarly named components in the FIGS. 1 and 2 structures. In structures 30,40 flame holding regions 34,44 are defined between disk shaped bluff body members 33*a*,33*b* and 43*a*,43*b* and around central members 35,45. In structure 30, similarly to structure 10, axial bore 37 in central member 35 extends a preselected distance axially of member 35 and terminates near a plurality of spaced circumferential fuel jets 38 disposed for injecting fuel at preselected angle (typically 45°) for mixing with air and burning within region 34. Vortex 39 defined by a recirculation zone within region 34 between members 33*a*,33*b* is extremely stable within a wide range of parameters defining fuel and air flow. In structure 40, similarly to structure 20, fuel jets 48 inject fuel into region 44 along the surface of member 43*a* substantially as shown. Vortex 49 resulting from fuel and air flow into in region 44 is also extremely stable over a wide range of fuel and air flow parameters.

It is noted that ignition within any of the structures illustrated and described herein and within the scope of the appended claims may be accomplished in any suitable manner and utilizing any suitable ignitor structure or type as is well known in the combustor art.

Figure 5:
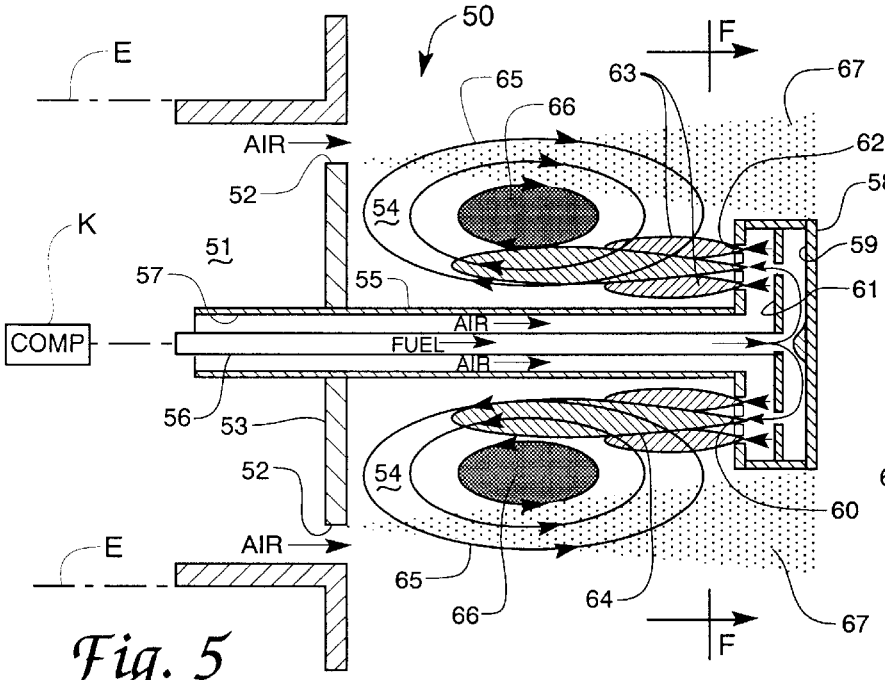
FIG. 5 illustrates in axial section another bluff body flame stabilizing structure according to the invention and showing the trapped vortex and areas of fuel/air injection, mix and burn.
Figure 6:
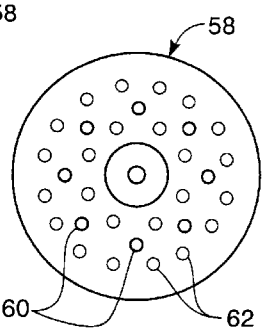
FIG. 6 is a view along lines F—F of FIG. 5.

Referring now to FIG. 5, shown therein is another bluff body flame stabilizing structure according to the invention in a configuration improved and preferred over those shown in FIGS. 3,4 and showing the trapped vortex and areas of fuel/air mixing and burn; FIG. 6 is a view along line F—F of FIG. 5. In structure 50, as in previously described structures, in the operation of engine E, air is supplied from compressor K or other source through duct 51. Air inlets 52 defined around and/or through disk shaped member 53 provide means for injecting air into annular flame holding region 54 surrounding central tubular member 55. Member 53 defines one of two bluff bodies disposed in tandem between which a vortex is trapped within structure 50. In the representative embodiment defined by structure 50, centrally disposed tubular member 55 comprises centrally located fuel line 56 around which is defined annular passageway 57 through which further air flow into region 54 may be provided. Tubular member 55 terminates at and supports disk shaped member 58 defining a second of the two bluff bodies between which the vortex is trapped according to the invention. The structure of member 58 includes first passageway 59 communicating with fuel line 56 for conducting fuel to and through a first plurality of fuel jets 60 for fuel injection into region 54 substantially as shown in FIG. 5, and second passageway 61 communicating with annular passageway 57 for conducting air to and through a second plurality of air inlets 62 for air injection into region 54. FIG. 6 shows representative locations of fuel jets 60 and air inlets 62 providing desirable fuel and air flow into flame holding region 54.

Figure 5A:
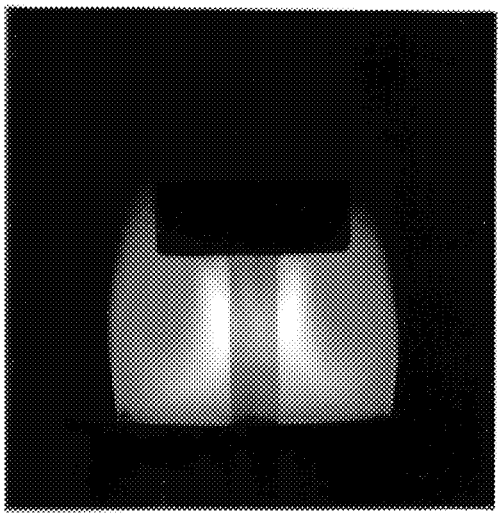
FIG. 5*a* shows a trapped vortex stabilized flame operating in the FIG. 5 combustor structure.
Figure 5B:
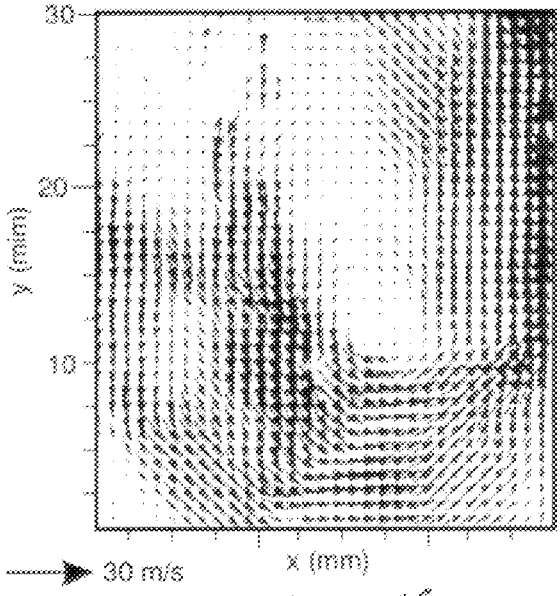
FIG. 5*b* shows the instantaneous velocity field of the trapped vortex flame of FIG. 5*a* as measured using a two color particle imaging velocimeter system.
Figure 5C:
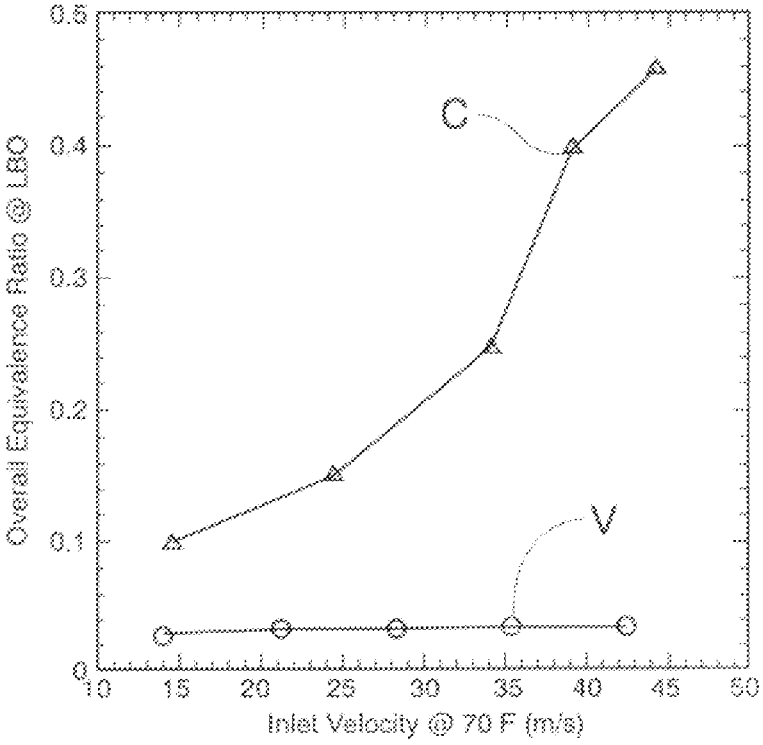
FIG. 5*c* contains plots of the equivalence ratio at lean-blow-out conditions for the trapped vortex combustor structure of FIG. 5 and a conventional swirl stabilized gas turbine combustor operating at room air inlet temperatures and ambient pressure, the fuel nozzle being modified for burning gaseous propane fuel.

In the operation of structure 50, air flow from air inlets 62 and fuel flow from fuel jets 60 define generally air rich regions 63 and fuel rich regions 64 extending rearwardly of member 58, substantially as shown in FIG. 5, and combine with air flow from air inlets 52 to define trapped vortex 65 in the recirculation zone within flame holding region 54. Regions 66 of rich burn and regions 67 of lean burn generally obtain from the fuel/air injection and recirculation defined by structure 50. In any structure of the invention described herein and illustrated in the figures, it is advantageous to provide fuel and air injection directly into the recirculation zone such as, in FIG. 5 is defined within region 54, because it provides control over the flame stabilization by controlling the local fuel to air ratio in recirculation region 65 for a wide range of air flow conditions at inlets 52. FIG. 5*a* shows a flame trapped in the cavity of combustor structure 50 illustrated in FIG. 5 at vortex 65 and the instantaneous velocity field of this flame is shown in FIG. 5*b*. The velocity field was measured using a two color particle imaging velocimeter and shows that a vortex is trapped in the cavity at 65 as described by the invention. Lean-blow-out data collected in the operation of combustor structure 50 (FIG. 5) is compared with the lean-blow-out limits for a conventional swirl stabilized gas turbine combustor both operating at ambient temperature and pressure and burning gaseous propane. The operational lean blow out results in FIG. 5*c* show that flame stability within flame holding region 54 in a combustor including the invention such as that represented by structure 50 (graph V) can be about an order of magnitude better than conventional combustors (graph C). The data also show that lean blow out equivalent ratios of the invention (graph V) is independent of air velocity through the combustor, whereas, there is a strong dependence of lean-blow-out limit with air velocity for conventional swirled stabilized combustors (graph C). The independence of the lean-blow-out limit on air velocity is the result of direct injection of fuel and air from 60 and 62 into the recirculation zone defining vortex 65. The combustor of the invention providing the data of TABLE I has been successfully operated at an equivalence ratio in the range of from 0.03 to 0.87, the upper limit of which not having been established because of testing facility limitations.

Figure 7:
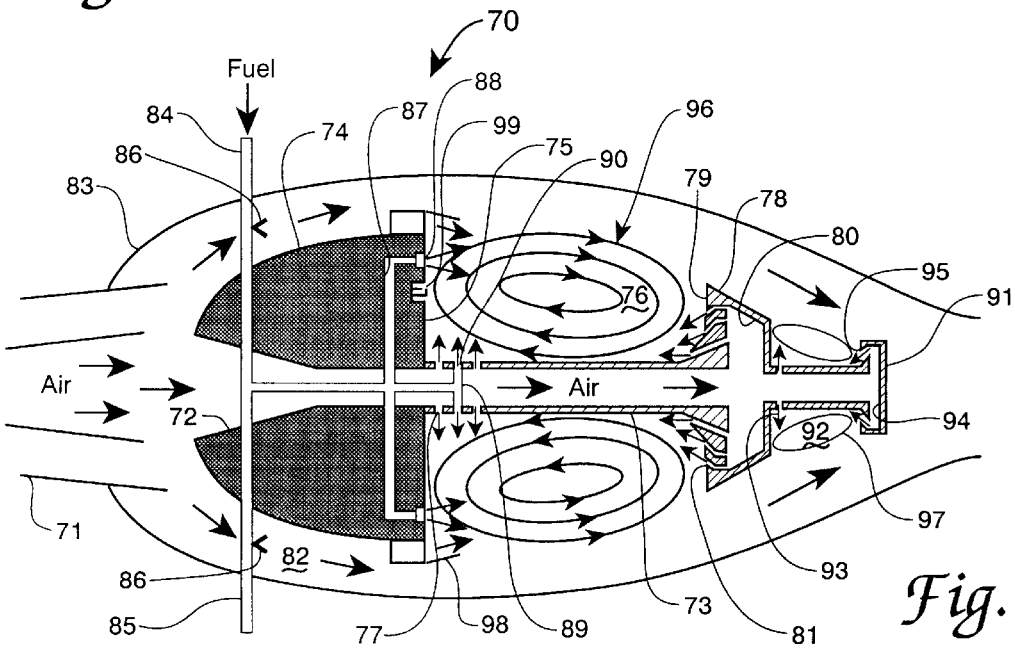
FIG. 7 illustrates in axial section yet another bluff body flame stabilizing structure according to the invention including fuel and air injection into the trapped vortex.

Referring now to FIG. 7, shown therein in axial section is yet another bluff body flame stabilizing structure 70 according to the invention, in a configuration particularly applicable to high speed air/fuel flows. Air is supplied through duct 71 and passageway 72 defined through conduit 73 disposed centrally of structure 70. Conduit 73 extends from a first bluff body 74 supporting a surface 75 defining a first boundary of flame holding region 76 within which a vortex is trapped according to the invention. First plurality of air inlets 77 are defined through conduit 73 near bluff body 74 for injecting air into region 76 along surface 75 substantially as indicated in FIG. 7. A first afterbody 78 is supported along conduit 73 and defines surface 79 defining a second boundary of region 76. The structure of afterbody 78 includes passageway 80 communicating with passageway 72 for conducting air to and through a second plurality air inlets 81 for additional air injection into region 76. Air is additionally supplied through annular duct 82 defined by combustor housing structure 83 along the periphery of region 76. Fuel is supplied from fuel lines 84 and 85 through body 74 and injected at fuel jets 86 into duct 82 for mixing with air flowed therealong. Fuel may also be supplied from fuel line 84 through second plurality of fuel line conduits 87 defined through body 74 for injection at fuel jets 88 directly into flame holding region 76, and further through third conduits 89 and fuel jets 90 into region 76 along with air injected at air inlets 77. Second afterbody 91 may be supported near the terminus of conduit 73 and defines with first afterbody 78 a second flame holding region 92. Conduit 73 may include air inlets 93 for flowing air into region 92. The afterbody 91 structure may include passageway 94 communicating with passageway 72 for conducting air to and through air inlets 95 providing further air injection into region 92. In the operation of a combustor including structure 70, a first vortex 96 is trapped within flame holding region 76 and provides for primary combustion within the combustor. A second vortex 97 may be trapped within second flame holding region 92 for supporting a flame fueled by fuel/air mixtures from region 76 and duct 82 which remain unburned in the primary combustion.

Igniter 99 of substantially conventional structure may be disposed at any suitable location near flame holding region 76 as suggested in FIG. 7.

FIG. 7 further illustrates representative placement of optional air deflector 98 for increasing the amount of air directed to the flame holding region. Means (not shown) may also be included and operatively connected to deflector 98 for selectively controlling the angle of the deflected air and the fuel-to-air ratio in the flame holding region.

Figure 8:
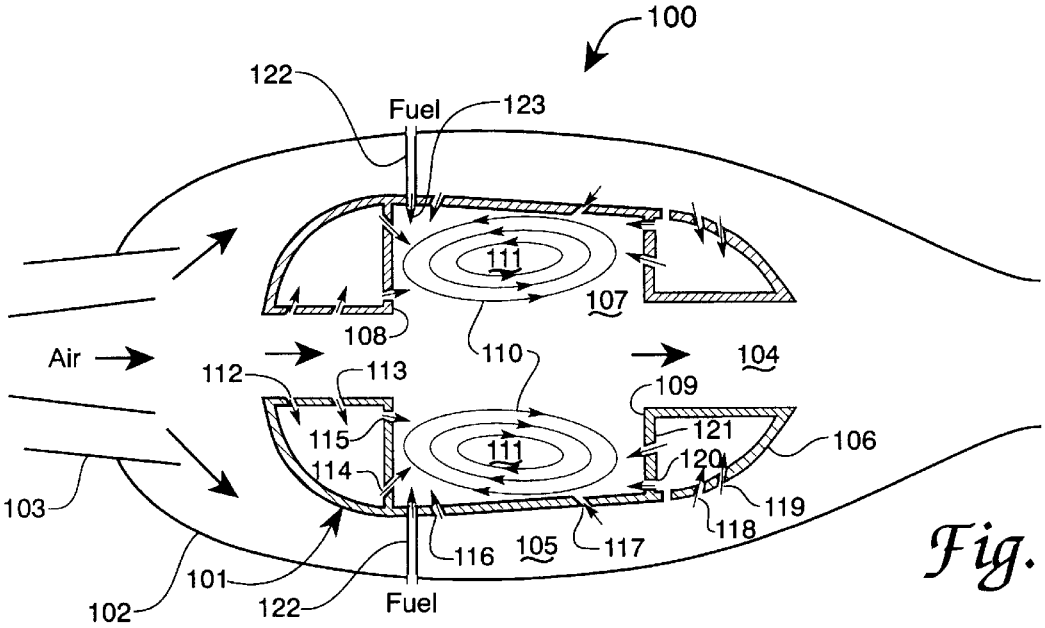
FIG. 8 illustrates in axial section the trapped vortex structure according to the invention defined as a cavity in a combustor liner.

Referring now to FIG. 8, shown therein in axial section is flame stabilizing structure 100 according to the invention, comprising a cavity defined in a combustor liner for trapping a vortex. In FIG. 8, structure 100 may comprise a generally axisymmetric combustor structure 101 disposed generally centrally of a supporting housing 102. Air from an engine compressor or other source may be supplied through duct 103 and may flow through duct 104 defined through combustor 101 for supporting primary combustion therein and through by-pass duct 105 defined by housing 102. Combustor liner 106 includes cavity 107 defined between confronting (generally annular) surfaces 108,109 for trapping vortex 110 therebetween in flame holding region 111 in accordance with these teachings. Any suitable plurality of air injection nozzles 112–115 may be defined through liner 106 for supplying air from duct 104 to region 111 and injecting air at a preselected angle, as suggested by the arrows in FIG. 8, for promoting the formation of vortex 110 within region 111. A second plurality of air injection nozzles 116–121 may be defined through liner 106 for conducting air from by-pass duct 105 to region 111 and injection at preselected angle also as suggested by arrows in FIG. 8. Additional air for supporting combustion within region 111 is provided at duct 104 along peripheral regions of vortex 110. Fuel lines 122 may be disposed for injecting fuel at a selected plurality of fuel jets 123 into flame holding region 111 such as along surface 108 at a desirable angle also selected to promote formation of vortex 110.

Figure 9:
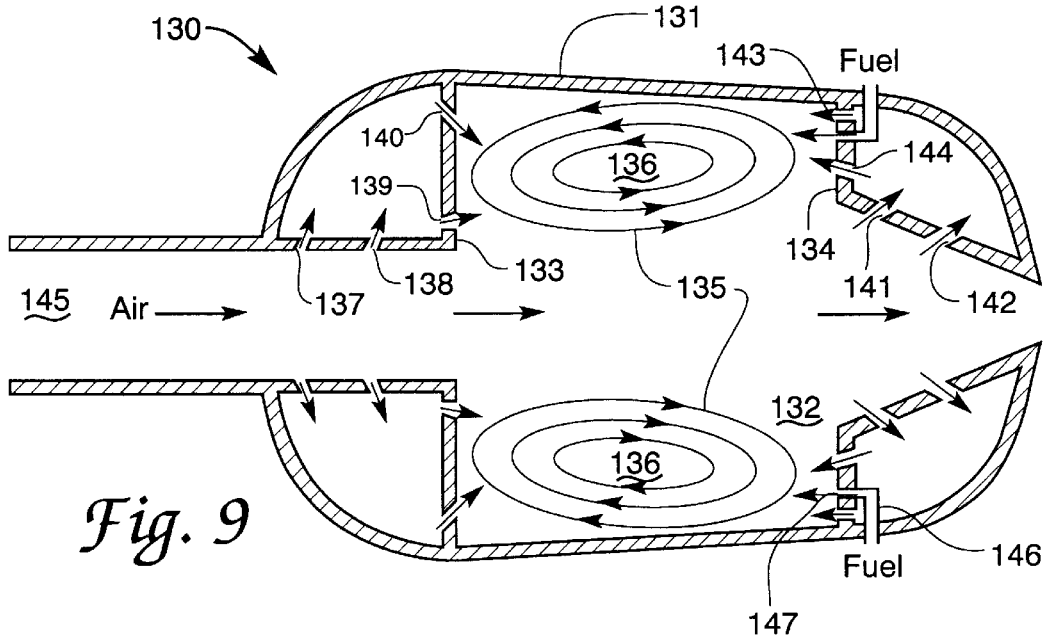
FIG. 9 illustrates in axial section the trapped vortex structure according to the invention defined as a cavity in a combustor wall.

In the structure illustrated in axial section in FIG. 9, combustor 130 includes a wall structure 131 defining cavity 132 between confronting (generally annular) surfaces 133, 134 for trapping a vortex 135 therebetween in flame holding region 136 according to the invention. Any suitable plurality of air injection nozzles 137–144 are defined through the liner wall as suggested in FIG. 9 for supplying air from duct 145 to region 136 and injecting air at preselected angle in manner similar to the structure of FIG. 8 in promoting the formation of vortex 135, and air for supporting combustion near the periphery of vortex 135 is supplied directly along duct 145. Fuel lines 146 and fuel jets 147 in suitable preselected plurality are shown disposed at surface 134 for providing fuel for burning within region 136 and for promoting formation of vortex 135; structure 100 also illustrates fuel injection points alternate to or in addition to those shown in FIGS. 5,7,8. Location and structure of igniters (not shown) for the FIGS. 8,9 structures may be selected by the skilled artisan guided by these teachings.

In applying the invention to the construction of a particular combustor or burner type, a structure defining the cavity for trapping the vortex is selected in consideration of various factors, including mass flow rate of the mainstream air, selected method for cavity cooling, burner geometry and size, ease of coupling with other systems (e.g., compressor, turbine, or heat exchanger), safety and durability. The geometry can be axisymmetric, annular, or two-dimensional, and design parameters are chosen considering the heat loading required, the fuel and air ratio in the trapped vortex, size and separation of the forebody and afterbody, the size, number and location of fuel and air injection points, pressure drop across the combustor, and a selection of active or passive control for the fuel-to-air loading in the trapped vortex.

In order to stabilize the flame in the trapped vortex structure of the invention, spacing of the bluff bodies (or cavity size) is selected depending on size and function of the combustor to which the invention is applied, and the type and location of the fuel and air jets are selected to promote the establishment of the trapped vortex. Stability may also depend on the air flow rate injected directly into the flame holding region (primary flow); for stability at low fuel flows, the primary air flow should be low, and for stability at high fuel flows the primary air flow rate should be high. In general, increasing the primary air flow rate shortens the flame.

Optimum separation between the tandem bluff bodies was found to be about 0.6 D where D is the diameter of the forebody or, stated alternatively, where D is substantially the diameter of the cavity. Separation may be greater for operation at high fuel and primary air flow conditions; however, the lean stability limit will not be as low as at optimum separation. Afterbody diameter should be about 0.75 D. The forebody and afterbody are preferably aerodynamically designed to reduce drag and pressure drop over the combustor length for high speed flows.

Overall size of the combustor structure defining or including the invention may be selected by one skilled in the combustor art in applying the invention to a specific combustor type, and is not considered limiting of the invention. By way of example only, the spacing between members 33*a*,33*b* and between members 43*a*,43*b* in demonstration structures 30,40 was about 64 mm, the diameters of members 33*a*,43*a* being about 70 mm and 33*b*,43*b* being about 57 mm; overall length of the central member in each structure was about 89 mm; fuel jets 38 were spaced about 38 mm from member 33*a*. In the FIG. 5 structure, member 53 was about 70 mm in diameter, and member 58 was about 51 mm in diameter spaced about 41 mm from member 53; fuel jets 60 were about 1.75 mm diameter and air inlets 62 were about 2.286 mm diameter.

Number, location and direction of the air injection nozzles are selected to strengthen or reinforce the trapped vortex and to promote fuel/air mixing, such as by injection from the afterbody in the FIG. 5,6 structures if bluff bodies are used to define the cavity, an advantage being a degree of cooling provided to the central member connecting the forebody and afterbody. In structures for accommodating high (such as ram) air flow, high pressure air may promote substantial air injection through inlets in the afterbody such as in representative structures of FIGS. 7,9. If in applying the structures of FIGS. 7,9 to ram air combustor types, the ram air inlet area (ducts 71,145) may be varied during operation to control fuel/air ratios in the flame holding region, which allows combustor operation over a large range of fuel and air flow rates.

Fuel injection is preferably defined near the surface of the forebody in a direction which reinforces the trapped vortex, such as radially across or out of the forebody cavity-defining surface (FIGS. 7,8) or from the leading surface of the forebody (FIG. 7) for operation at or near an equivalence ratio of one. For total fuel and oxygen consumption in the combustion process, about 15 times more air than fuel by mass is required. Rapid fuel and air mixing is promoted by providing suitable pluralities of spatially distributed fuel and air injection points as suggested most clearly in FIG. 7, with the size and number of fuel jets and air inlets selected accordingly to provide correspondingly higher air flow rate than fuel flow rate. The jets may be angled to promote swirling of the trapped vortex about the central axis within the recirculation zone of the combustor, which will extend the residence time of the fuel and air so that complete combustion can occur in a shorter distance. Either liquid or gaseous fuels can be burned. If a viscous liquid fuel is used, a structure providing fuel injection from the afterbody (FIG. 5) may be preferred to provide some preheating of the fuel within the combustor structure.

A combustor structured according to the invention may also be operated utilizing premixing of the fuel and air, and injecting the mixture in manner such as illustrated for fuel injection in FIG. 9. Fuel/air premixing may be accomplished at any suitable location, such as within the forebody or afterbody structures just prior to injection into the flame holding region.

Combustors structured according to the invention therefore provide significant advantages over previously existing combustors, including active control of the fuel and air ratio in the combustion zone, efficient operation with either high or low pressure air, and ability to burn either liquid or gaseous fuel. The structures of the invention are simple in construction, compact and inexpensive in fabrication, provide a stable flame with wide fuel and air operating limits, have a low pressure drop and high combustion efficiencies, and are characterized by low levels of exhaust pollutants such as nitric oxides, soot, carbon monoxide, and total unburned hydrocarbons.

The invention therefore provides an improved combustor structure providing flame stabilization utilizing a trapped vortex in the combustion zone. It is understood that modifications to the invention may be made as might occur to one skilled in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

We claim:

1. A combustor structure comprising:

(a) a housing defined along a substantially central axis;

(b) means defining a pair of axially spaced bluff bodies disposed along said central axis, said bluff bodies defining therebetween a substantially annularly shaped cavity for trapping therewithin a vortex including a mixture of fuel and air for combustion within said cavity whereby a flame within said combustor is stabilized within said cavity;

(c) wherein the spacing between said bluff bodies is about 0.6 times the diameter of said cavity; and (d) means for injecting fuel and air into said cavity disposed within said cavity for promoting circulation a mixture of fuel and air within said cavity.

* * * * *